United States Patent [19]

Fierens

[11] Patent Number: 4,696,037

[45] Date of Patent: Sep. 22, 1987

[54] LOUDSPEAKER ARRANGEMENT COMPRISING ONE OR MORE FLAT DIAPHRAGMS

[75] Inventor: Gustaaf E. M. Fierens, Dendermonde, Belgium

[73] Assignee: U.S. Philips Corporation, New York, N.Y.

[21] Appl. No.: 565,309

[22] Filed: Dec. 27, 1983

[30] Foreign Application Priority Data

Jan. 4, 1983 [NL] Netherlands ..... 8300011

[51] Int. Cl.[4] ..... H04R 5/00

[52] U.S. Cl. ..... 381/24; 381/90; 181/145

[58] Field of Search ..... 181/141, 143, 145, 150, 181/163; 381/24, 86, 88, 89, 90

[56] References Cited

U.S. PATENT DOCUMENTS

| | | | |
|---|---|---|---|
| 1,988,250 | 1/1935 | Olson | 181/147 |
| 3,182,130 | 5/1965 | Zeiss | 381/86 |
| 3,752,258 | 8/1973 | Ishikawa | 181/145 |
| 4,139,734 | 2/1979 | Fincham | 181/145 |
| 4,441,577 | 4/1984 | Kurihara | 181/147 |
| 4,451,711 | 5/1984 | Jackson | 381/90 |
| 4,451,928 | 5/1984 | Murayama | 381/86 |
| 4,502,149 | 2/1985 | Gefvert | 381/24 |

FOREIGN PATENT DOCUMENTS

| | | | |
|---|---|---|---|
| 0015186 | 9/1980 | European Pat. Off. | 381/24 |
| 2428950 | 2/1980 | France | 181/163 |
| 55-96790 | 7/1980 | Japan | 381/86 |
| 1604766 | 12/1981 | United Kingdom | 381/24 |

OTHER PUBLICATIONS

Brady et al., Swing Out Hinge Connector, RCA TN No.:360, Jun. 1960.

*Primary Examiner*—Forester W. Isen
*Attorney, Agent, or Firm*—Robert T. Mayer; Bernard Franzblau

[57] ABSTRACT

A modular loudspeaker comprises a first module including a first loudspeaker unit (1) for reproducing a low-frequency audio signal and provided with at least two flat diaphragms (4, 5) and a second module including a second loudspeaker unit (2) for reproducing a high-frequency audio signal by means of a loudspeaker (8). The first and second loudspeaker units are constructed either to be mechanically detached from one another or to have connecting means whereby they can be rigidly mechanically connected to one another in a manner that will permit relatively easy mechanical detachment of the units from one another. Connecting means (10 or 11) allows the loudspeaker units to be electrically connected to one another and comprise interengageable parts that can be disengaged to disconnect the units. Another loudspeaker arrangement, which need not be of a modular construction, comprises a first loudspeaker unit (60) having at least one flat-diaphragm loudspeaker (61) and a second loudspeaker unit (62) which is pivotable about two orthogonal axes (65, 66).

30 Claims, 6 Drawing Figures

LOUDSPEAKER ARRANGEMENT COMPRISING ONE OR MORE FLAT DIAPHRAGMS

Figure 1:
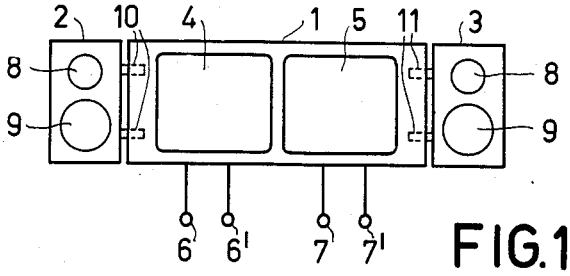

The invention relates to a loudspeaker arrangement comprising a first loudspeaker unit for reproducing a low-frequency audio signal and a second separate loudspeaker unit provided with a loudspeaker for reproducing a high-frequency audio signal. The two loudspeaker units are constructed either to have no rigid mechanical connection between them or are provided with connecting means whereby they can be rigidly mechanically connected to one another in a manner that will permit detachment of the units from one another. Connecting means are provided whereby the loudspeaker units can be electrically connected to one another and which comprise interengageable parts that can be disengaged from one another to disconnect the units from one another. The invention also relates to a loudspeaker unit for use in a loudspeaker arrangement in accordance with the invention.

A loudspeaker arrangement of the type mentioned in the opening paragraph is disclosed in German Gebrauchsmuster DE-GM 78.34.296. This known loudspeaker arrangement comprises modules which can be coupled to each other so as to be electrically and mechanically disconnectible by connecting means in the form of connectors.

It is an object of the invention to provide a loudspeaker arrangement with a modular construction which offers more possibilities than the known loudspeaker arrangement and which in particular is very suitable for use as a loudspeaker system in motor cars. According to the invention, the loudspeaker arrangement is characterized in that the first loudspeaker unit comprises at least two flat diaphragms. Preferably, the flat diaphragms extend at least substantially in one plane, have a rectangular, but preferably square shape and are adjacent each other along one side. The flat diaphragms of the first loudspeaker unit may each form part of a flat-diaphragm loudspeaker. This means that the first loudspeaker unit comprises two flat-diaphragm loudspeakers. However, alternatively one flat diaphragm may form part of a flat-diaphragm loudspeaker and the other flat diaphragm may form part of a passive radiator. The step in accordance with the invention, of providing the module of the first loudspeaker unit with (at least) two flat diaphragms, is first of all based on the recognition that this module can function in different ways in the loudspeaker arrangement and the two flat diaphragms in said module can cooperate in different ways with one (or more) second loudspeaker unit (or loudspeaker units). Moreover, the step in accordance with the invention is based on the insight that the use of two flat diaphragms may have a positive effect on the dimensions of the first loudspeaker unit. The use of flat diaphragms (flat-diaphragm loudspeakers), instead of the more frequently used cone loudspeakers, enables the thickness of the first loudspeaker unit to be reduced. In flat-diaphragm loudspeakers the end of the voice-coil former is generally secured directly or via an auxiliary cone to the flat diaphragm. In either case the distance between said end of the voice-coil former and the "front-face" of the flat diaphragm is smaller than the distance between the end of the voice-coil former and the plane defined by the rim of the cone in the case of a cone loudspeaker. This means that the flat-diaphragm loudspeaker can generally be thinner than a cone loudspeaker of the same acoustic output power. This reduced thickness is advantageous if the loudspeaker arrangement is used in a car and is mounted on the rear deck behind the back seat of the car. The loudspeaker arrangement then occupies a smaller volume. When two square flat-diaphragm loudspeakers are used the width dimension is also smaller than in the case in which one cone loudspeaker is employed. This may be explained as follows. If the acoustic output power of the two flat-diaphragm loudspeakers and the acoustic output power of the cone loudspeaker must be equal to each other with the same average excursion of the diaphragms of the flat-diaphragm loudspeaker and the cone loudspeaker, the surface areas of the two flat diaphragms must be equal to the surface area of the diaphragm of the cone loudspeaker. When square flat diaphragms are used a calculation will show that one side of the flat diaphragm is smaller than the external diameter of the (cone) diaphragm. This smaller dimension is also of advantage because the loudspeaker arrangement in accordance with the invention can now be dimensioned so that it can be accommodated on the (generally narrow) rear-deck panel behind the back-seat of a car and is still capable of delivering an adequate acoustic output power.

An embodiment of the loudspeaker arrangement in accordance with the invention is characterized in that the flat diaphragms each form part of a flat-diaphragm loudspeaker, the loudspeaker arrangement being provided with a first and a second input terminal for receiving a first and a second electric audio signal respectively, for example the left-hand and the right-hand signal of a stereophonic signal, and for applying the first and the second electric signal to the first and the second flat-diaphragm loudspeaker, respectively. Preferably, the first loudspeaker unit is provided with these first and second input terminals. In this way one flat-diaphragm loudspeaker will supply the one (left-hand) signal and the other flat-diaphragm loudspeaker the other (right-hand) signal. The loudspeaker arrangement may further be characterized in that it further comprises a third separate loudspeaker unit provided with a loudspeaker for reproducing a high-frequency audio signal, and being constructed either to have no rigid mechanical connection between them or being provided with connecting means whereby they can be rigidly mechanically connected to one another but which will permit detachment of the units from one another. Conecting means are provided whereby the first and third loudspeaker units can be electrically connected to one another and which comprise interengageable parts that can be disengaged from one another to disconnect the units from one another. The first and the second input terminal are coupled to the second and the third loudspeaker units, respectively for applying the first and the second electric signals to the second and the third loudspeaker units respectively. The second and the third loudspeaker units may be connected to the first loudspeaker unit both electrically and mechanically. Then they are each connected to one of two opposite sides of the first loudspeaker unit and radiate the one (left-hand) and the other (right-hand) signal respectively. Alternatively, the second and the third loudspeaker units may be arranged at a specific distance from and diametrically opposite the first loudspeaker unit. However, this requires the use of an electrical connection by means of leads.

Another embodiment of the loudspeaker arrangement in accordance with the invention is characterized in that the flat diaphragms each form part of a flat-diaphragm loudspeaker and the loudspeaker arrangement is provided with an input terminal for receiving an electric audio signal and for applying this signal to the first and the second flat-diaphragm loudspeakers and to the second loudspeaker unit. Preferably, the first loudspeaker unit is provided with these first and second input terminals. The two flat-diaphragm loudspeakers now deliver the same acoustic output signal (namely the low-frequency portion thereof) and the second loudspeaker unit, which may be arranged at some distance from the first loudspeaker unit or which is connected to it so as to be mechanically detachable, delivers the same acoustic output signal (namely the high-frequency portion thereof). This signal may be for example the left-hand signal of a stereo signal. In that case there will be provided a second loudspeaker arrangement which reproduces the right-hand signal. Alternatively, the signal may be a monophonic signal.

Yet another embodiment of the loudspeaker arrangement in accordance with the invention is characterized in that one flat diaphragm forms part of a flat-diaphragm loudspeaker and the other flat diaphragm forms part of the passive radiator. The loudspeaker arrangement is accommodated in an opening of an otherwise at least substantially airtight enclosure and is provided with an input terminal for receiving an electric audio signal and for applying this electric signal to the flat-diaphragm loudspeaker and to the second loudspeaker unit. This embodiment is very suitable for normal home-entertainment use, such as in a loudspeaker box. The second (and, if present, the third) loudspeaker unit may also comprise a second loudspeaker for reproducing a mid-range audio-frequency signal.

It is to be noted that Japanese Kokai No. 55-46623 describes a loudspeaker arrangement with four flat-diaphragm loudspeakers, of which three loudspeakers reproduce a low-frequency audio signal and of which one loudspeaker reproduces both a medium-range frequency and a high-frequency audio signal. However, this known loudspeaker arrangement is not of a modular construction.

In a preferred embodiment of the loudspeaker arrangement in accordance with the invention the loudspeaker(s) in the second (and, if present, in the third) loudspeaker unit is (are) pivotable about at least one axis. This enables the more directional and more concentrated radiation from the second and the third loudspeaker units to be aimed at the listener in an optimum manner.

A loudspeaker arrangement, comprising a first loudspeaker unit for reproducing a low-frequency audio signal and a second loudspeaker unit for reproducing a high-frequency audio signal, is characterized in that the first loudspeaker unit comprises at least one flat-diaphragm loudspeaker, the second loudspeaker unit comprising a loudspeaker for reproducing a high-frequency audio signal and, optionally, a loudspeaker for reproducing a mid-range audio-frequency signal. The second loudspeaker unit is pivotable about two at least substantially orthogonal axes, one axis extending at least substantially perpendicular to the surface of the flat diaphragm. This loudspeaker arrangement is also very suitable for use on the rear-deck panel behind the backseat of a car. From Japanese Kokai No. 57-116495 a loudspeaker arrangement is known which greatly resembles the loudspeaker arrangement described above. However, the second loudspeaker unit in the known loudspeaker arrangement is pivotable about one axis only, which is a disadvantage for use in cars. The loudspeaker arrangement is generally arranged in such a way that the flat diaphragm extends horizontally. This is possible because the first loudspeaker unit has a spherical radiation pattern. The one pivotal axis of the second loudspeaker unit then serves to obtain the radiation of the second loudspeaker unit in a horizontal plane. A rotation in the horizontal plane (about the other—second—axis) is then important to enable the second loudspeaker unit to be directed towards the listener in an optimum manner. The loudspeaker arrangement described in Japanese Kokai No. 57-116495 does not have this last-mentioned possibility.

Figure 2:
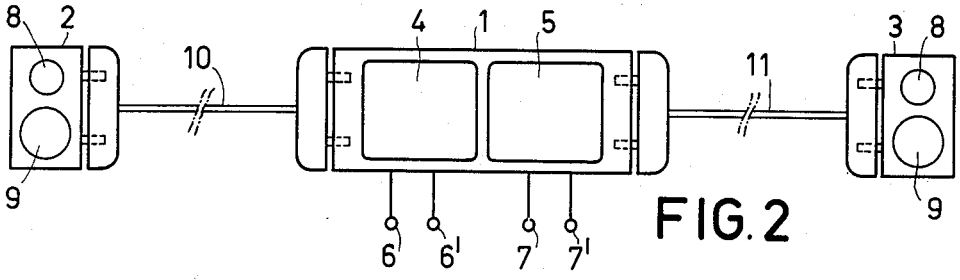

The invention will now be described in more detail, by way of example, with reference to the drawings. In the drawings:

FIG. 1 shows a first,

FIG. 2 a second, and

Figure 3:
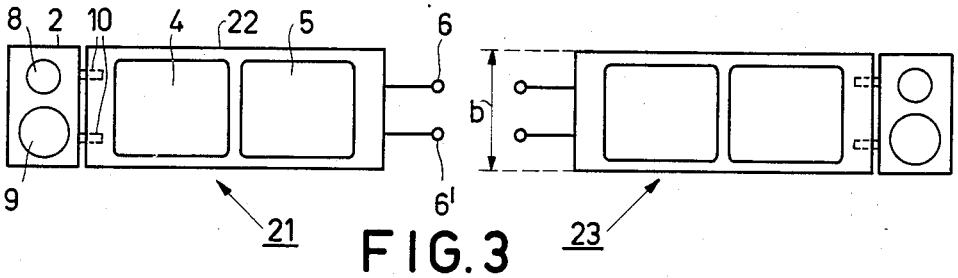
Figure 4:
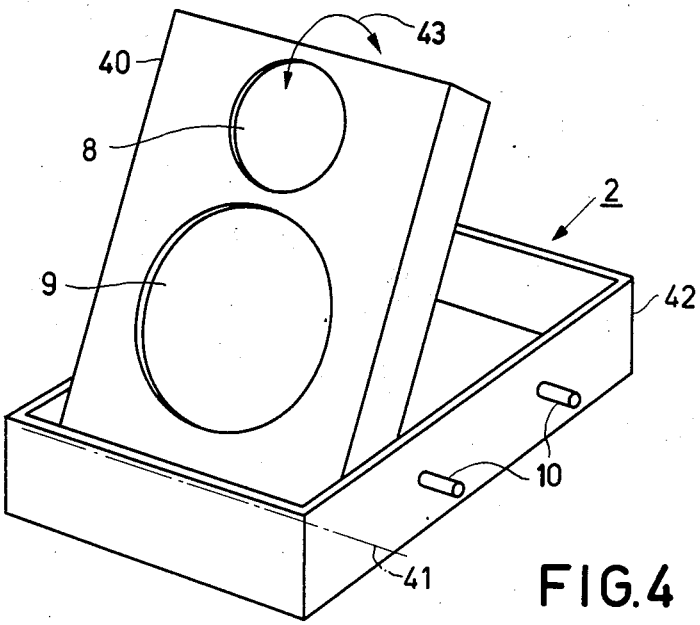
Figure 5:
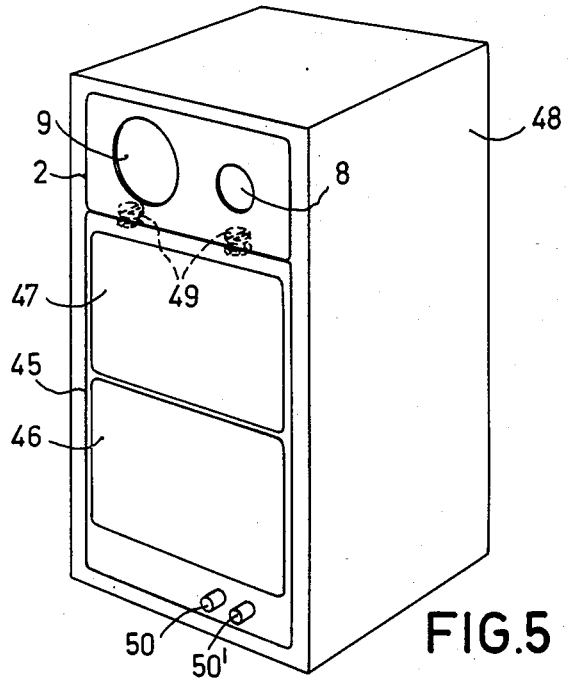
Figure 6:
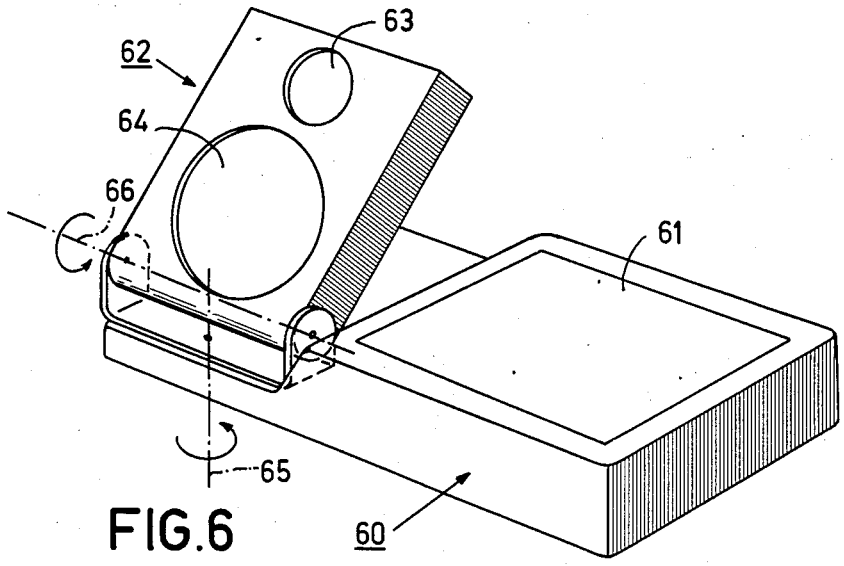

FIG. 3 a third embodiment of the invention,

FIG. 4 shows an example of the second loudspeaker unit whose loudspeaker(s) is (are) pivotable about at least one axis, FIG. 5 shows a fourth, and FIG. 6 a fifth embodiment of the invention. Identical reference numerals in the various Figures denote identical elements.

FIG. 1 is a plan view of a first embodiment. The loudspeaker arragement comprises a first loudspeaker unit 1 which is a module with two flat-diaphragm loudspeakers 3 and 4. The two flat diaphragms of these loudspeakers are disposed at least substantially in one plane, have a rectangular, but preferably square circumference and are adjacent each other along one side. The flat-diaphragm loudspeakers 4 and 5 are intended for the reproduction of a substantially low-frequency audio signal. Such loudspeakers are also referred to as woofers. The first loudspeaker unit 1 is provided with a first and a second input terminal 6—6' and 7—7' respectively, for receiving a first and a second electric audio signal, respectively. The signal may be, for example, a stereophonic signal. The left-hand signal is then applied to the first input terminal 6—6' and the right-hand signal to the second input terminal 7—7'. Further, the loudspeaker arrangement comprises two other modules, namely the second loudspeaker unit 2 provided with a loudspeaker 8 (a tweeter), for example in the form of a dome loudspeaker, for reproducing the high-frequency audio signal, and a loudspeaker 9 (a squawker), for example also in the form of a dome loudspeaker, for the reproduction of a mid-range audio frequency signal, and a third loudspeaker unit 3 also comprising a tweeter 8 and a squawker 9. It is not necessary to divide the entire audible frequency range into three parts. It is alternatively possible to divide the frequency range into two parts. Then the second and the third loudspeaker unit will each comprise only one loudspeaker 8. The loudspeaker arrangement comprises connecting means 10 for coupling the first loudspeaker unit 1 electrically and mechanically to the second loudspeaker unit 2. The mechanical connection is a rigid connection, that is to say, it is not flexible. The expression "rigid connection" is to be understood to include a pivotal connection. The connecting means 10 permit the loudspeaker units 1 and 2 to be electrically disconnected and also mechanically disconnected, i.e. detached, from one another. The connecting means 10 comprise interengageable parts which can be disengaged from one another to effect the electrical disconnection and mechanical detachment of the units 1 and 2 from one another. The connecting means 10 take the form of a pin and hole or a plug and socket. It is obvious that other types of connecting means may be used. In the embodiment shown in FIG. 1 the connecting means 10 provide both the mechanical and the electrical coupling between the loudspeaker units 1 and 2. Alternatively, the connecting means 10 may provide only a disconnectable electrical coupling between the two units or modules 1 and 2. In that case there must be additional connecting means (not shown) for providing a disconnectable rigid mechanical coupling between the two modules. The loudspeaker arrangement also comprises connecting means 11 for coupling the first loudspeaker unit 1 electrically and mechanically to a third loudspeaker unit 3. This connecting means also has a construction such as to permit the units 1 and 3 to be electrically and mechanically disconnected from one another. The connecting means 11 are also constructed as a pin and hole or a plug and socket. What has been stated for the connecting means 10 also applies to the connecting means 11. Via the first input terminal 6—6' the first (left-hand) signal can be applied to the first flat-diaphragm loudspeaker 4 and, via the connecting means 10, to the second loudspeaker unit 2. Via the second input terminal 7—7' the second (right-hand) signal can be applied to the second flat-diaphragm loudspeaker 5 and, via the connecting means 11, to the third loudspeaker unit 3. Instead of the loudspeaker unit 1, the loudspeaker units 2 and 3 may be provided with input terminals (namely one terminal for each unit). Via the input terminal of loudspeaker unit 2 the one (left-hand) signal must then be applied to the second loudspeaker unit 2 and (via the connecting means 10) to the flat-diaphragm loudspeaker 4. Via the input terminal of the loudspeaker unit 3 the other (right-hand) signal must then be applied to the third loudspeaker unit 3 and (via the connecting means 11) to the flat-diaphragm loudspeaker 5.

This results in a compact loudspeaker arrangement which comprises three modules and is capable of reproducing a stereophonic signal. The left-hand signal is then reproduced by the loudspeaker unit 2 (namely the mid-range and high-frequency parts) and the loudspeaker 4 (for the low-frequency part). The right-hand signal is then reproduced by the loudspeaker unit 3 (for the mid-range and high-frequency part) and loudspeaker 5 (for the low-frequency part). Such a loudspeaker arrangement is particularly suitable for use in cars because of its dimensions. The loudspeakeer arrangement can be mounted on the shelf behind the back seat. The surfaces of the two flat-diaphragms 4 and 5 are then disposed in a horizontal plane. For the bass reproduction this presents no problems because the flat-diaphragm loudspeakers 4 and 5 have substantially spherical directivity patterns. The squawker 9 and the tweeter 8, however, have directivity patterns which are highly concentrated in a vertical direction (i.e. in FIG. 1 in a direction perpendicular to the plane of the drawing). For directing the acoustic sound radiation towards the listener(s) in an optimum manner, the sound must be radiated in a more horizontal direction. This may be achieved by constructing the second and the third loudspeaker units 2 and 3 in the manner shown in FIG. 4. FIG. 4 shows an example of the loudspeaker unit 2. The loudspeakers 8 and 9 are accommodated in an enclosure 40 which is pivotable about the axis 41 in a casing 42. The casing 42 carries the connecting means 10 by means of which the loudspeaker unit 2 can be electrically and mechanically coupled to the loudspeaker unit 1 in such a way as to allow the two units to be electrically and mechanically disconnected from one another. The enclosure 40 with the loudspeakers 8 and 9 is pivotally mounted in the casing 42 in such a way that it can be placed in an arbitrary position between the position in which it lies inside the casing and the fully upright position, see the arrow 43. If the enclosure 40 is in a substantially vertical position the sound is radiated in the horizontal direction.

FIG. 2 is a plan view of an embodiment which greatly resembles that of FIG. 1. The only difference is that the second and the third loudspeakers 2 and 3 are spaced from each other. This provides a better stereophonic reproduction. In this embodiment there is no need for the provision of means for establishing rigid mechanical connections between the loudspeaker unit 1 and the loudspeaker units 2 and 3. Consequently, the connecting means 10 and 11 now only provide the electrically disconnectable coupling between the loudspeaker unit 1 and the loudspeaker unit 2 or the loudspeaker unit 3, and they comprise two leads with the plugs and sockets necessary to make the electrical contact with the various loudspeaker units. In this case the loudspeaker units 2 and 3 may also be of the same construction as shown in FIG. 4.

FIG. 3 is a plan view of a third embodiment. The loudspeaker arrangement 21 in FIG. 3 comprises two modules, namely a module 22, which is the first loudspeaker unit, and a module 2, which is the second loudspeaker unit. The loudspeaker unit 22 is provided with two flat-diaphragm loudspeakers 4 and 5 and with an input terminal 6—6' for receiving an electric signal and for applying this signal to the two flat-diaphragm loudspeakers 4 and 5. Again connecting means 10 are provided for electrically and mechanically coupling the loudspeaker units 2 and 22 to each other in such a way that they can be electrically and mechanically disconnected from one another. The connecting means are again constructed as a pin and hole or a plug and socket. The signal applied to the terminals 6—6' is also applied to the second loudspeaker unit 2 via the connecting means 10.

The arrangement 21 is capable of reproducing a signal (for example a monophonic signal or the signal from one channel of a stereophonic signal). The loudspeakers 4 and 5 then reproduce the low-frequency part and the loudspeakers 8 and 9 the high-frequency part and the medium range part, respectively.

If by means of the arrangement 21 the one (left-hand) channel of a stereophonic signal is reproduced, a second arrangement, such as 23 in FIG. 3, is required for the reproduction of the other (right-hand) channel of the stereophonic signal. As regards the placement of the loudspeakers in the arrangement, the arrangement 23 should (preferably) be mirror-inverted relative to the arrangement 21.

It is to be noted that the embodiments shown in FIGS. 1, 2 and 3 are particularly suitable for use as loudspeaker arrangements in cars because of their dimensions. In particular the width dimension b, as indicated for the loudspeaker arrangement 23 in FIG. 3, may be adapted so that the arrangement can readily be accommodated on the shelf behind the back seat of a car. The use of flat-diaphragm loudspeakers has the advantage that the height of the loudspeaker arrangement (i.e. the dimension in a direction perpendicular to the plane of drawing) can be reduced. As a result of this, the arrangement will occupy a small(er) volume and is therefore very suitable for mounting on the rear shelf in a car.

The embodiments of FIGS. 2 and 3 have a further advantage in that the high frequency (and if present, the mid frequency) signals can be radiated along the sides of the head rests, if present, on the rear seats of the car, so that the sound can reach the front part of the passenger compartment.

FIG. 5 shows an embodiment of the invention for home-entertainment use. The loudspeaker arrangement is accommodated in an opening of an otherwise at least substantially air-tight enclosure (or loudspeaker box) 48. If a loudspeaker box of small dimensions is required, the amount of air enclosed in the box volume presents a certain spring force to the diaphragms. Frequently a passive radiator is employed in order to reduce this force. Passive radiators have been known for a long time, see U.S. Pat. No. 1,988,250, and in principle comprise solely a diaphragm which can vibrate under the influence of air-pressure variations in the loudspeaker box. The effective stiffness constant of the air enclosed in the box is thereby reduced so that the spring force is also reduced. This results, inter alia, in a higher acoustic output power, especially for the low frequencies. For this purpose the embodiment shown in FIG. 5 comprises a first loudspeaker unit 45 with a flat-diaphragm loudspeaker 46 and a passive radiator 47. Moreover, the loudspeaker arrangement comprises a second loudspeaker unit 2 with a loudspeaker 8 and a loudspeaker 9. The loudspeaker unit 2 has already been described with reference to FIGS. 1, 2, 3 and 4. The flat-diaphragm loudspeaker 46 reproduces a substantially low-frequency audio signal. Screw and nut connecting means 49 provide both a disconnectable electrical coupling and a disconnectable rigid mechanical coupling between the loudspeaker units 2 and 45. The loudspeaker arrangement is provided with an input terminal 50—50' for receiving an electric signal and applying the electric signal to the flat-diaphragm loudspeaker 46 and to the second loudspeaker unit 2.

FIG. 6 shows another embodiment. This embodiment comprises a first loudspeaker unit 60 having at least one flat diaphragm 61 for reproducing a low-frequency audio signal and a second loudspeaker unit 62 having a loudspeaker 63 for reproducing a high-frequency audio signal and a loudspeaker 64 for reproducing a mid-range audio frequency signal. The second loudspeaker unit 62 is pivotable about two orthogonal axes 65 and 66 respectively. One of the axes, namely the axis 65, extends perpendicular to the surface of the flat diaphragm 61. This enables the pivotable loudspeaker unit 62 to be aimed at the listener in an optimum manner so that this loudspeaker arrangement is particularly suitable for use in cars (rear-deck mounting).

It is to be noted that the invention is not limited to the embodiments described with reference to the drawing. The invention also relates to those embodiments which differ from the embodiments described with respect to points which are not relevant to the inventive idea.

What is claimed is:

1. A loudspeaker arrangement comprising: a first loudspeaker unit for reproducing a low-frequency audio signal, a second separate loudspeaker unit provided with a loudspeaker for reproducing a high-frequency audio signal, the two loudspeaker units being constructed to have no mechanical connection between them, and means electrically connecting the loudspeaker units to one another and which comprise interengageable parts that can be disengaged from one another to disconnect the units, characterized in that the first loudspeaker unit comprises at least two flat diaphragms.

2. A loudspeaker arrangement as claimed in claim 1, characterized in that the flat diaphragms extend at least substantially in one plane, have a rectangular shape and are adjacent each other along one side.

3. A loudspeaker arrangement as claimed in claim 1 wherein the flat diaphragms each form part of a flat-diaphragm loudspeaker, and first and second input terminals for receiving and applying first and second electric audio signals to the first and second flat-diaphragm loudspeakers, respectively, and to the second loudspeaker unit via said electric connecting means.

4. A loudspeaker arrangement as claimed in claim 3, characterized in that the loudspeaker arrangement further comprises a third separate loudspeaker unit provided with a loudspeaker for reproducing a primarily high-frequency audio signal, the first and third loudspeaker units being constructed to be mechanically detached, and means electrically connecting the first and third loudspeaker units to one another and which comprise interengageable parts that can be easily disengaged from one another to disconnect the first and third loudspeaker units from one another, and wherein the first and the second input terminals are coupled to the second and the third loudspeaker units respectively, for applying the first and the second electric audio signals to the second and the third loudspeaker units, respectively.

5. A loudspeaker arrangement as claimed in claim 1 wherein the loudspeaker in the second loudspeaker unit is pivotably mounted about at least one axis.

6. A loudspeaker arrangement as claimed in claim 2 wherein the flat diaphragms form part of first and second flat-diaphragm loudspeakers, respectively, and first and second input terminals for applying first and second electric audio signals to the first and second flat-diaphragm loudspeakers, respectively.

7. A loudspeaker arrangement as claimed in claim 2 wherein the flat diaphragms form part of first and second flat-diaphragm loudspeakers, respectively, and an input terminal for applying an electric audio signal to the first and second flat-diaphragm loudspeakers and to the second loudspeaker unit.

8. A loudspeaker arrangement as claimed in claim 2 wherein one flat diaphragm forms part of a flat-diaphragm loudspeaker and the other flat diaphragm forms part of a passive radiator, the loudspeaker arrangement being accommodated in an opening of an otherwise at least substantially airtight enclosure, and an input terminal for receiving and applying an electric audio signal to the flat-diaphragm loudspeaker and to the second loudspeaker unit.

9. A loudspeaker arrangement as claimed in claim 2 wherein the second loudspeaker unit comprises a second loudspeaker for producing a mid-range audio frequency signal.

10. A loudspeaker arrangement as claimed in claim 2 wherein the second loudspeaker unit is pivotably mounted about at least one axis.

11. A loudspeaker arrangement as claimed in claim 4 wherein the second and third loudspeaker units include a second loudspeaker for reproducing mid-range audio frequency signals.

12. A loudspeaker arrangement as claimed in claim 4 wherein the loudspeakers in the second and third loudspeaker units are pivotable about at least one axis.

13. A loudspeaker arrangement comprising: a first loudspeaker unit for reproducing a low-frequency audio signal, a second separate loudspeaker unit provided with a loudspeaker for reproducing a primarily high-frequency audio signal, the two loudspeaker units having connecting means whereby they can be mechanically connected to one another in a manner that will permit ready detachment of the units from one another, said connecting means allowing the loudspeaker units to be electrically connected to one another and further comprising interengageable parts that can be disengaged from one another to disconnect the loudspeaker units from one another, characterized in that the first loudspeaker unit comprises at least first and second flat diaphragms.

14. A loudspeaker arrangement as claimed in claim 13 wherein said first and second flat diaphragms are rectangular and are disposed side-by-side adjacent one another in a common plane.

15. A loudspeaker arrangement as claimed in claim 13 wherein the loudspeaker arrangement further comprises a third separate loudspeaker unit having a loudspeaker for reproducing a primarily high-frequency audio signal, the first and third loudspeaker units having connecting means whereby they can be mechanically connected to one another in a manner that will permit ready detachment of the first and third units from one another, said connecting means allowing the first and third loudspeaker units to be electrically connected to one another and further comprising interengageable parts that can be disengaged from one another to disconnect the first and third units from one another, and first and second input terminals coupled to the second and the third loudspeaker units for receiving and applying first and second electric audio signals to the first, second and third loudspeaker units.

16. A loudspeaker arrangement as claimed in claim 15 wherein the second and third loudspeaker units are pivotably mounted about at least one axis.

17. A loudspeaker arrangement as claimed in claim 13 wherein at least one of said flat diaphragms forms part of a flat-diaphragm loudspeaker, said second loudspeaker unit including a loudspeaker for reproducing a mid-range audio frequency signal, and wherein the second loudspeaker unit is pivotably mounted about two orthogonal axes one of which extends substantially perpendicular to the surface of a flat diaphragm.

18. A loudspeaker arrangement as claimed in claim 14 wherein the first and second flat diaphragms are part of first and second flat diaphragm loudspeakers, respectively, and the second loudspeaker unit comprises a second loudspeaker for reproducing mid-range audio frequency signals, and at least one input terminal for receiving and applying an electric audio signal to the first and second flat-diaphragm loudspeakers and to the second loudspeaker unit.

19. A loudspeaker arrangement comprising: a first loudspeaker unit for reproducing a low-frequency audio signal, a second separate loudspeaker unit provided with a loudspeaker for reproducing a high-frequency audio signal, the two loudspeaker units being constructed to have no rigid mechanical connection between them, and electrical connecting means being provided whereby the loudspeaker units can be electrically connected to one another and which comprise interengageable parts that can be disengaged from one another to disconnect the units, characterized in that the first loudspeaker unit comprises at least two flat diaphragms.

20. A loudspeaker arrangement as claimed in claim 19 wherein the flat diaphragms extend at least substantially in one plane, have a rectangular shape and adjoin each other along one side.

21. A loudspeaker arrangement as claimed in claim 19, characterized in that the flat diaphragms each form part of a flat-diaphragm loudspeaker, first and second input terminals for receiving first and second electric audio signals, respectively, and for applying the first and second electric signals to the first and second flat-diaphragm loudspeakers, respectively.

22. A loudspeaker arrangement as claimed in claim 21 further comprising: a third separate loudspeaker unit provided with a loudspeaker for reproducing a high frequency audio signal, the first and third loudspeaker units being constructed to have no rigid mechanical connection therebetween, and electrical connecting means whereby the first and third loudspeaker units can be electrically connected to one another and which comprise interengageable parts that can be disengaged from one another to disconnect the units, and the first and the second input terminals being coupled to the second and the third loudspeaker units, respectively, for applying the first and second electric signals to the second and third loudspeaker units, respectively.

23. A loudspeaker arrangement as claimed in claim 19 wherein the flat diaphragms each form part of a flat-diaphragm loudspeaker, and an input terminal for receiving and applying an electric audio signal to the first and the second flat-diaphragm loudspeaker and to the second loudspeaker unit.

24. A loudspeaker arrangement as claimed in claim 19 wherein one flat diaphragm forms part of a flat-diaphragm loudspeaker and the other flat diaphragm forms part of a passive radiator, the loudspeaker arrangement being accommodated in an opening of an otherwise at least substantially airtight enclosure, and an input terminal for receiving and applying an electric audio signal to the flat-diaphragm loudspeaker and to the second loudspeaker unit.

25. A loudspeaker arrangement as claimed in claim 19 wherein the second loudspeaker unit comprises a second loudspeaker for reproducing a mid-range audio frequency signal.

26. A loudspeaker arrangement as claimed in claim 19, characterized in that the loudspeaker(s) in the second loudspeaker unit is (are) pivotably mounted about at least one axis.

27. A loudspeaker arrangement comprising: a first loudspeaker unit for reproducing a low-frequency audio signal, a second separate loudspeaker unit provided with a loudspeaker for reproducing a high-frequency audio signal, the two loudspeaker units having mechanical connecting means whereby they can be rigidly mechanically connected to one another but which will permit detachment of the units from one another, and electrical connecting means being provided whereby the loudspeaker units can be electrically connected to one another and which comprise interengageable parts that can be disengaged from one another to disconnect the units from one another, characterized in that the first loudspeaker unit comprises at least two flat diaphragms.

28. A loudspeaker arragement as claimed in claim 27, characterized in that the flat diaphragms each form part of a flat-diaphragm loudspeaker, first and second input terminals for receiving first and second electric audio signals, respectively, said audio signals comprising the left-hand and the right-hand signal of a stereophonic signal, and for applying the first and second electric signals to the first and second flat-diaphragm loudspeakers, respectively.

29. A loudspeaker arrangement as claimed in claim 28 further comprising: a third separate loudspeaker unit provided with a loudspeaker for reproducing a high frequency audio signal, the first and third loudspeaker units including mechanical connecting means whereby they can be rigidly mechanically connected to one another but which will permit detachment of the units from one another, and electrical connecting means whereby the first and third loudspeaker units can be electrically connected to one another and which comprise interengageable parts that can be disengaged from one another to disconnect the units, and the first and second input terminals being coupled to the second and third loudspeaker units, respectively, for applying the first and second electric signals to the second and third loudspeaker units, respectively.

30. A loudspeaker arrangement as claimed in claim 27 wherein the electrical connecting means and mechanical connecting means are combined into one connecting means.

* * * * *